US011795899B1

(12) United States Patent
Sim et al.

(10) Patent No.: US 11,795,899 B1
(45) Date of Patent: Oct. 24, 2023

(54) SYSTEM OF IGNITION COIL

(71) Applicants: Hyundai Motor Company, Seoul (KR); Kia Corporation, Seoul (KR)

(72) Inventors: Kiseon Sim, Suwon-si (KR); Soo Hyung Woo, Seoul (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/973,064

(22) Filed: Oct. 25, 2022

(30) Foreign Application Priority Data

Jun. 21, 2022 (KR) ..... 10-2022-0075531

(51) Int. Cl.
*F02P 3/045* (2006.01)
*F02P 3/055* (2006.01)
*F02P 3/05* (2006.01)

(52) U.S. Cl.
CPC ..... *F02P 3/045* (2013.01); *F02P 3/05* (2013.01); *F02P 3/055* (2013.01)

(58) Field of Classification Search
CPC ..... F02P 3/045; F02P 3/05; F02P 3/055
See application file for complete search history.

(56) References Cited

U.S. PATENT DOCUMENTS 9,429,134 B2 8/2016 Desai et al.
10,006,432 B2 6/2018 Desai et al.
2015/0176558 A1* 6/2015 Glugla ..... F02P 3/0456 123/294

FOREIGN PATENT DOCUMENTS

DE 102018210581 A1 * 5/2019 ..... F02P 17/12
JP 2016048065 A * 4/2016

OTHER PUBLICATIONS

Machine Translation of JP2016048065A PDF File Name: "JP2016048065A_Machine_Translation.pdf".*
Machine Translation of DE102018210581A1 PDF File Name: "DE102018210581A1_Machine_Translation.pdf".*

* cited by examiner

*Primary Examiner* — Grant Moubry
*Assistant Examiner* — Ruben Picon-Feliciano
(74) *Attorney, Agent, or Firm* — Slater Matsil, LLP

(57) ABSTRACT

An embodiment system includes an ignition coil including a primary coil and a secondary coil, a high voltage battery selectively electrically connected the primary coil, a low voltage battery selectively electrically connected to the primary coil, and an electric and electronic element provided between the high voltage battery, the low voltage battery, and the primary coil of the ignition coil to selectively supply electric power of the high voltage battery or the low voltage battery to the primary coil.

20 Claims, 4 Drawing Sheets

SYSTEM OF IGNITION COIL

CROSS-REFERENCE TO RELATED APPLICATIONS

This application claims the benefit of Korean Patent Application No. 10-2022-0075531, filed on Jun. 21, 2022, which application is hereby incorporated herein by reference.

TECHNICAL FIELD

The present invention relates to a system of an ignition coil.

BACKGROUND

In gasoline vehicles, a mixture of air and fuel is ignited by a spark generated by a spark plug to be combusted. That is, the air-fuel mixture injected into a combustion chamber during a compression stroke is ignited by a discharge phenomenon of the spark plug, and thus energy required for vehicle driving is generated while undergoing a high temperature and high pressure expansion process.

The spark plug provided in the gasoline vehicle serves to ignite a compressed air-fuel mixture by spark discharge caused by a high voltage current generated by an ignition coil.

Power cannot be supplied to the ignition coil when the SOC (state of charge) of a battery is low or when an output of the battery becomes very low due to an abnormal cause while the vehicle is travelling.

When ignition fails because power is not supplied to the ignition coil during operation of the engine, serious damage to a catalytic converter disposed at a downstream portion of the engine may occur, and the vehicle may not be able to travel normally.

The above information disclosed in this background section is only for enhancement of understanding of the background of embodiments of the invention, and therefore it may contain information that does not form the prior art that is already known to a person of ordinary skill in the art.

SUMMARY

The present invention relates to a system of an ignition coil. Particular embodiments relate to a system of an ignition coil capable of being powered from a plurality of batteries.

Embodiments of the present invention provide a system of an ignition coil that may supply electric power to the ignition coil when the electric power is not supplied through a battery due to an abnormal cause.

A system of an ignition coil according to an embodiment of the present invention may include an ignition coil including a primary coil and a secondary coil, a high voltage battery selectively electrically connected to the primary coil to supply electric power to the ignition coil, a low voltage battery selectively electrically connected to the primary coil to supply electric power to the ignition coil, and an electric and electronic element provided between the high voltage battery, the low voltage battery, and the primary coil of the ignition coil to selectively supply electric power of the high voltage battery or the low voltage battery to the primary coil.

The electric and electronic element may include a battery switch provided between the high voltage battery, the low voltage battery, and the primary coil of the ignition coil, wherein electric power may be selectively supplied to the primary coil of the ignition coil from the high voltage battery or the low voltage battery according to switching of the battery switch.

The electric and electronic element may include a battery switch provided between the high voltage battery and the primary coil of the ignition coil and a diode provided between the low voltage battery and the primary coil of the ignition coil.

Electric power may be supplied from the low voltage battery to the ignition coil through the electric and electronic element when the high voltage battery operates abnormally.

A dwell time of a control signal when the ignition coil is charged through the low voltage battery may be set to longer than a dwell time of a control signal when the ignition coil is charged through the high voltage battery.

According to the system of the ignition coil according to an embodiment of the present invention as described above, when any one battery does not operate normally in a vehicle in which at least two batteries are mounted, it is possible to stably supply electric power (or current) to the ignition coil through the other battery.

Furthermore, by supplying stable electric power to the ignition coil, it is possible to prevent the degradation of the vehicle's catalyst and to ensure the stable driving of the vehicle.

BRIEF DESCRIPTION OF THE DRAWINGS

These drawings are for reference only in describing embodiments of the present invention, and therefore, the technical idea of embodiments of the present invention should not be limited to the accompanying drawings.

Figure 1:
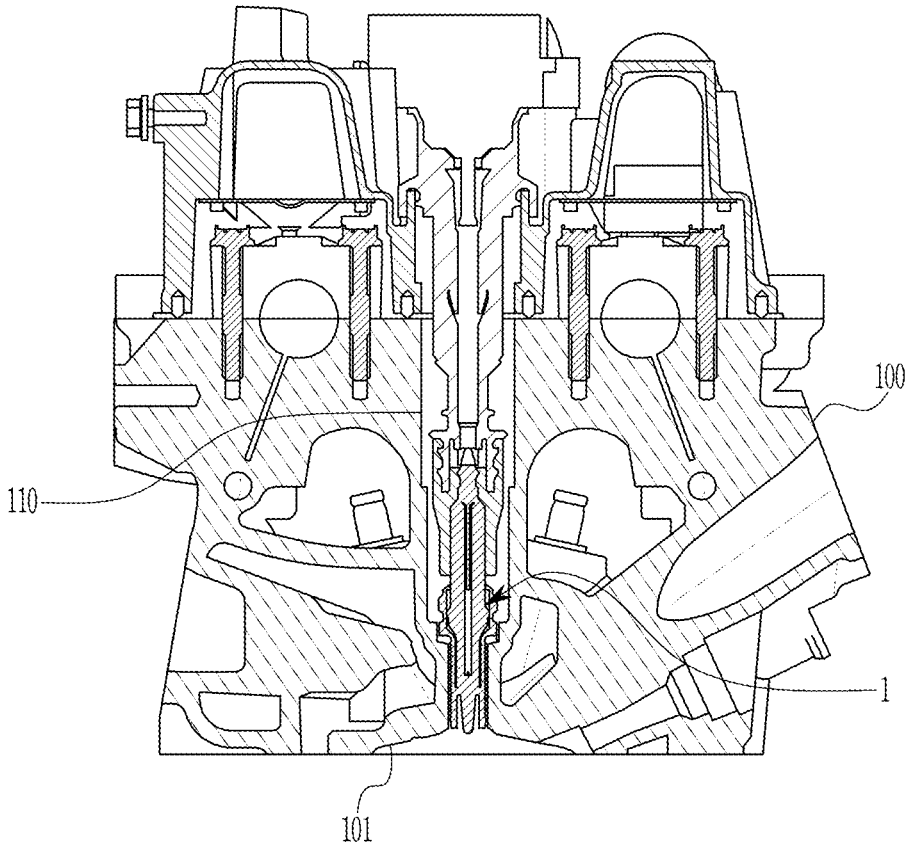
FIG. 1 illustrates a cross-sectional view of an engine in which a spark plug is mounted according to an embodiment of the present invention.

The following reference identifiers may be used in connection with the accompanying drawings to describe exemplary embodiments of the present disclosure.

1: spark plug
2: center electrode
3: ground electrode
10: first ignition coil
11: primary coil
12: secondary coil
13: diode
15: main switch
16: emitter terminal
17: base terminal
18: collector terminal
19: diode
30: high voltage battery
35-1, 35-2: battery switch
37: diode
40: low voltage battery

50: controller
100: cylinder head
101: combustion chamber
110: mount hole

DETAILED DESCRIPTION OF ILLUSTRATIVE EMBODIMENTS

The present invention will be described more fully hereinafter with reference to the accompanying drawings, in which embodiments of the invention are shown. As those skilled in the art would realize, the described embodiments may be modified in various different ways, all without departing from the spirit or scope of the present invention.

In order to clearly describe embodiments of the present invention, parts that are irrelevant to the description are omitted, and identical or similar constituent elements throughout the specification are denoted by the same reference numerals.

In addition, since the size and thickness of each configuration shown in the drawings are arbitrarily shown for convenience of description, embodiments of the present invention are not necessarily limited to configurations illustrated in the drawings, and in order to clearly illustrate several parts and areas, enlarged thicknesses are shown.

Hereinafter, a system of an ignition coil according to an embodiment of the present invention will be described in detail with reference to the accompanying drawings.

FIG. 1 illustrates a cross-sectional view of an engine in which a spark plug is mounted according to an embodiment of the present invention.

As shown in FIG. 1, a spark plug 1 according to an embodiment of the present invention is mounted on a cylinder of an engine and generates spark discharge.

The engine to which the spark plug 1 is applied includes a cylinder block and a cylinder head 100, and the cylinder block and the cylinder head 100 are combined to form a combustion chamber 101 therein. An air and fuel mixture inflowing into the combustion chamber 101 is ignited by spark discharge generated by the spark plug 1.

In the cylinder head 100, a mount hole 110 in which the spark plug 1 is mounted is vertically formed long. A lower portion of the spark plug 1 that is mounted in the mount hole 110 protrudes into the combustion chamber 101. A center electrode 2 and a ground electrode 3 that are electrically connected to an ignition coil are formed at the lower portion of the spark plug 1, and the spark discharge is generated between the center electrode 2 and the ground electrode 3.

Figure 2:
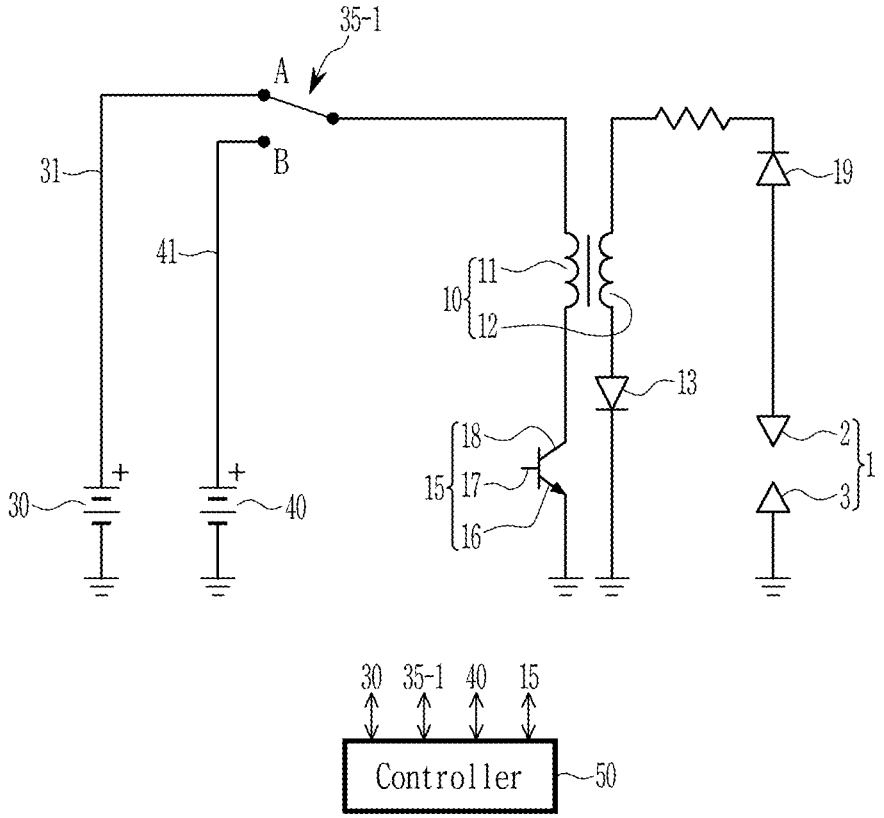
FIG. 2 illustrates a schematic view of a system of an ignition coil according to a first embodiment of the present invention.

FIG. 2 illustrates a schematic view of a system of an ignition coil according to a first embodiment of the present invention.

As shown in FIG. 2, a system of an ignition coil according to a first embodiment of the present invention includes an ignition coil 10 selectively powered from a high voltage battery 30 (e.g., a 48 V battery) and a low voltage battery 40 (e.g., a 12 V battery), and a controller 50 controlling spark discharge generated between a pair of electrodes 2 and 3 by adjusting a charging current and a charging time (duration), and performing switching control so that electric power is selectively supplied to the ignition coil 10 from the high voltage battery 30 or the low voltage battery 40.

The ignition coil 10 includes a primary coil 11 and a secondary coil 12, one end of the primary coil 11 is selectively electrically connected to the high voltage battery 30 and the low voltage battery 40 of the vehicle, and the other end of the primary coil 11 is grounded through a main switch 15. According to an on/off operation of the main switch 15, the primary coil 11 of the first ignition coil 10 may be selectively electrically connected.

In an embodiment of the present invention, two batteries mounted in the vehicle may include the high voltage battery 30 and the low voltage battery 40. The high voltage battery 30 may be mainly used for supplying electrical power to a drive motor that generates power required for travelling of the vehicle, and the low voltage battery 40 may be mainly used for suppling electrical power to electronic components.

The main switch 15 may be realized with a transistor switch (for example, an insulated gate bipolar transistor (IGBT)) including an emitter terminal 16, a collector terminal 18, and a base terminal 17. That is, the other end of the primary coil 11 may be electrically connected to the collector terminal 18 of the main switch 15, the emitter terminal 16 thereof may be grounded, and the base terminal 17 thereof may be electrically connected to the controller 50.

One end of the secondary coil 12 is electrically connected to the center electrode 2, and the other end thereof is electrically connected to the emitter terminal 16 of the main switch 15. A diode 13 is installed between the secondary coil 12 and the emitter terminal 16 to block a current from flowing from the secondary coil 12 to the emitter terminal 16.

In addition, a diode 19 is installed between the secondary coil 12 and the center electrode 2, so that a current flows only from the secondary coil 12 to the center electrode 2.

An electric and electronic element that supplies power of the high voltage battery 30 or the low voltage battery 40 to the primary coil 11 of the ignition coil 10 is provided between the high voltage battery 30, the low voltage battery 40, and the primary coil 11 of the ignition coil 10.

The electric and electronic element may include a first battery switch 35-1 provided between the high voltage battery 30, the low voltage battery 40, and the primary coil 11 of the ignition coil 10 (refer to FIG. 2). According to switching of the first battery switch 35-1, electric power is supplied to the primary coil 11 of the ignition coil 10 from the high voltage battery 30 or the low voltage battery 40.

In other words, the high voltage battery 30 is electrically connected to the primary coil 11 of the ignition coil 10 through a first electric line 31, and the low voltage battery 40 is electrically connected to the primary coil 11 of the ignition coil 10 through a second electric line 41. At this time, the first battery switch 35-1 is installed at a point where the first electric line 31 and the second electric line 41 are joined.

Accordingly, depending on switching (or, ON or OFF) of the first battery switch 35-1, the high voltage battery 30 is electrically connected to the primary coil 11 of the ignition coil 10 through the first electric line 31, or the low voltage battery 40 is electrically connected to the primary coil 11 of the ignition coil 10 through the second electric line 41.

The controller 50 controls switching (or, ON or OFF) of the electric and electronic element (e.g., the first battery switch 35-1) so that electric power of the high voltage battery 30 or electric power of the low voltage battery 40 is selectively supplied to the primary coil 11 of the ignition coil 10, and controls switching (or, ON or OFF) of the main switch 15 so that the ignition coil 10 is charged or discharged.

To this end, the controller 50 may be provided as at least one processor executed by a predetermined program, and the predetermined program is configured to perform respective steps of a control method of the system of the ignition coil according to an embodiment of the present invention.

When the electric and electronic element (e.g., the first battery switch 35-1) is turned ON, the electric power is supplied to the primary coil 11 of the ignition coil 10 from the high voltage battery 30. And when the electric and electronic element (e.g., the first battery switch 35-1) is turned OFF, the electric power is supplied to the primary coil 11 of the ignition coil 10 from the low voltage battery 40.

When a control signal is applied to the base terminal 17 of the main switch 15 by the controller 50, the primary coil 11 of the ignition coil 10 is electrically connected, and electrical energy is charged to the primary coil 11. When no control signal is applied to the base terminal 17 of the main switch 15 by the controller 50, a high voltage current (or discharge current) is generated in the secondary coil 12 due to electromagnetic induction of the primary coil 11 and the secondary coil 12. The discharge current generated in the secondary coil 12 flows to the center electrode 2, and while spark discharge is generated between the center electrode 2 and the ground electrode 3 by the discharge current generated in the secondary coil 12, an air-fuel mixture inside the combustion chamber 101 is ignited.

That is, the controller 50 charges or discharges the ignition coil 10 by turning the main switch 15 on/off. When the controller 50 applies the control signal to the base terminal 17 of the main switch 15 (when the main switch is turned on), the primary coil 11 is charged (or the first ignition coil is charged).

In addition, when the controller 50 does not apply a control signal to the base terminal 17 of the main switch 15 (or when the main switch is turned off), a high voltage current is generated in the secondary coil 12 due to electromagnetic induction with the primary coil 11, and spark discharge is generated between the center electrode 2 and the ground electrode 3 (or the ignition coil is discharged) by the high voltage current generated in the secondary coil 12.

In a normal state, the controller 50 turns on the electric and electronic element (e.g., the first battery switch 35-1), and accordingly, electric power is supplied to the primary coil 11 of the ignition coil 10 from the high voltage battery 30 (or a current flows).

When the electric power is supplied to the ignition coil 10 from the high voltage battery 30, the controller 50 controls charging and discharging of the ignition coil 10 by adjusting a dwell time of the control signal applied to the main switch 15.

Figure 3:
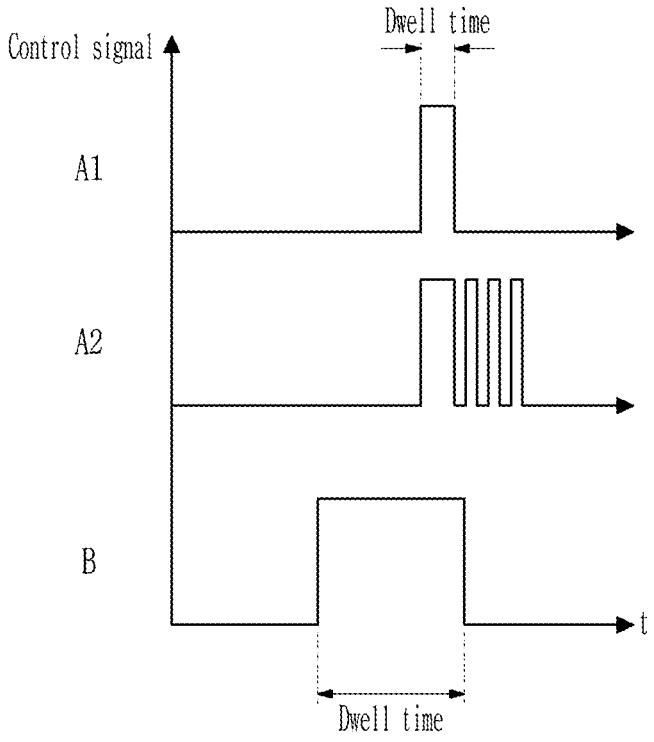
FIG. 3 illustrates a graph showing control signals according to an embodiment of the present invention.

For example, when the electric power is supplied to the ignition coil 10 from the high voltage battery 30, the controller 50 sets the dwell time of the control signal applied to the main switch 15 to be relatively short to charge the ignition coil 10 (see 'A1' of FIG. 3), or the controller 50 performs multi-stage ignition of the ignition coil 10 through the control signal including a plurality of pulses applied to the main switch 15 (see 'A2' of FIG. 3).

On the contrary, in an abnormal state (e.g., when the SOC of the high voltage battery is very low, or when the electric power of the high voltage battery is cut off due to abnormal causes, etc.), the controller 50 turns off the electric and electronic element (e.g., the first battery switch 35-1), and accordingly, the electric power is supplied to the primary coil 11 of the ignition coil 10 from the low voltage battery 40 (current flows from the low voltage battery 40 to the primary coil 11 of the ignition coil 10).

When the electric power is supplied to the ignition coil 10 from the low voltage battery 40, the controller 50 controls the charging and discharging of the ignition coil 10 by adjusting the dwell time of the control signal applied to the main switch 15.

At this time, the dwell time of the control signal when the ignition coil 10 is charged through the low voltage battery 40 is set longer than the dwell time of the control signal when the ignition coil 10 is charged through the high voltage battery 30 (see 'B' of FIG. 3).

In this way, since the dwell time of the control signal controlling the charging of the ignition coil 10 through the low voltage battery 40 is set to be relatively long, it is possible to obtain sufficient ignition energy when the ignition coil 10 is charged through the low voltage battery 40 with a relatively low output voltage.

Now, a system of an ignition coil according to a second embodiment of the present invention will be described in detail with reference to the accompanying drawings.

Figure 4:
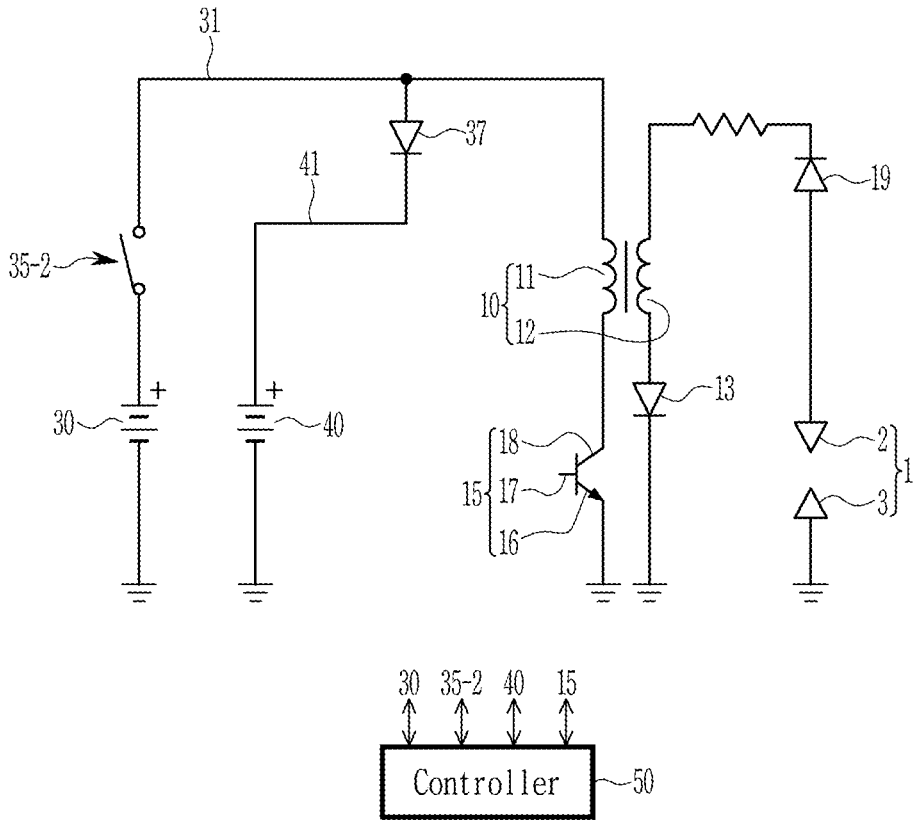
FIG. 4 illustrates a schematic view of a system of an ignition coil according to a second embodiment of the present invention.

FIG. 4 illustrates a schematic view of a system of an ignition coil according to a second embodiment of the present invention.

Other constituent elements of the second embodiment of the present invention are the same as the first embodiment of the present invention except the electric and electronic element. Therefore, in the following, only the parts that are different from the first embodiment will be described in detail.

The electric and electronic element may include a second battery switch 35-2 provided between the high voltage battery 30 and the primary coil 11 of the ignition coil 10 and a diode 37 provided between the low voltage battery 40 and the primary coil 11 of the ignition coil 10 (see FIG. 4).

By the diode 37, current flows only from the low voltage battery 40 to the primary coil 11 of the ignition coil 10, and current does not flow from the high voltage battery 30 (or, the primary coil 11 of the ignition coil 10) to the low voltage battery 40.

In detail, when the second battery switch 35-2 is turned on, the electric power is supplied from the high voltage battery 30 to the primary coil 11 of the ignition coil 10. Although both the high voltage battery 30 and the low voltage battery 40 are electrically connected to the primary coil 11 of the ignition coil 10, since the voltage of the high voltage battery 30 (e.g., 48 V) is higher than the voltage of the low voltage battery 40 (e.g., 12 V), current does not flow from the low voltage battery 40 to the primary coil 11 of the ignition coil 10, and current only flows from the high voltage battery 30 to the primary coil 11 of the ignition coil 10. In other words, since a reverse-directional voltage is applied to the diode 37, current only flows from the high voltage battery 30 to the primary coil 11 of the ignition coil 10, and current does not flow from the low voltage battery 40 to the primary coil 11 of the ignition coil 10.

When the second battery switch 35-2 is turned off, the output voltage of the high voltage battery 30 becomes 0 V, the output voltage (e.g., 12 V) of the low voltage battery 40 is applied to an upstream side (or a front end) of the diode 37, and 0 V is applied to a downstream side (or a rear end) of the diode 37, therefore, current flows from the low voltage battery 40 to the primary coil 11 of the ignition coil 10. In other words, since forward-directional voltage is applied to the diode 37, current flows from the low voltage battery 40 to the primary coil 11 of the ignition coil 10.

Since the operation of the second embodiment of the present invention is the same as the operation of the first embodiment of the present invention as described above, a detailed description will be omitted.

According to the system of the ignition coil according to an embodiment of the present invention as described above, when any one battery does not operate normally in a vehicle in which a plurality of batteries are mounted, it is possible to stably supply electric power (or current) to the ignition coil through the other battery.

Furthermore, by supplying stable electric power to the ignition coil, it is possible to prevent the degradation of the vehicle's catalyst and to ensure the stable driving of the vehicle.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A system comprising:

an ignition coil comprising a primary coil and a secondary coil;

a high voltage battery selectively electrically connected the primary coil;

a low voltage battery selectively electrically connected to the primary coil;

a battery switch provided between the high voltage battery and the primary coil of the ignition coil to selectively supply electric power of the high voltage battery to the primary coil; and a diode provided between the low voltage battery and the primary coil of the ignition coil, wherein the diode is coupled so that current can flow from the low voltage battery to the primary coil of the ignition coil, but current cannot flow from the high voltage battery to the low voltage battery.

2. The system of claim 1, wherein the electric power is selectively supplied to the primary coil of the ignition coil from the high voltage battery or the low voltage battery according to switching of the battery switch.

3. The system of claim 1, wherein the electric power is supplied from the low voltage battery to the ignition coil through the diode when the high voltage battery operates abnormally.

4. The system of claim 1, wherein a first dwell time of a first control signal when the ignition coil is charged through the low voltage battery is set to be longer than a second dwell time of a second control signal when the ignition coil is charged through the high voltage battery.

5. The system of claim 1, further comprising a main switch, wherein a second end of the primary coil is grounded through the main switch.

6. The system of claim 5, wherein the main switch comprises an emitter terminal, a collector terminal, and a base terminal.

7. The system of claim 6, wherein the second end of the primary coil is electrically connected to the collector terminal of the main switch and the emitter terminal is grounded.

8. The system of claim 7, wherein a second end of the secondary coil is electrically connected to the emitter terminal of the main switch.

9. The system of claim 8, further comprising a first further diode provided between the secondary coil and the emitter terminal.

10. The system of claim 9, further comprising a second further diode provided between the secondary coil and a spark plug connection.

11. An engine comprising:

a cylinder block;

a cylinder head combined with the cylinder block to define a combustion chamber therein;

a spark plug mounted in a mount hole of the cylinder head, wherein a lower portion of the spark plug protrudes into the combustion chamber;

a center electrode provided at the lower portion of the spark plug;

a ground electrode provided at the lower portion of the spark plug;

an ignition coil electrically connected to the center electrode and the ground electrode and comprising a primary coil and a secondary coil, wherein the ignition coil is configured to be selectively powered from a high voltage battery or a low voltage battery by control of a controller;

a battery switch provided between the high voltage battery and the primary coil of the ignition coil, wherein electric power is supplied to the ignition coil according to switching of the battery switch; and a diode provided between the low voltage battery and the primary coil of the ignition coil, wherein the diode is coupled so that current can flow from the low voltage battery to the primary coil of the ignition coil, but current cannot flow from the high voltage battery to the low voltage battery.

12. The engine of claim 11, wherein the controller is configured to:

control spark discharge generated between the center electrode and the ground electrode by adjusting a charging current and a charging time; and perform switching control so that the electric power is selectively supplied to the ignition coil from the high voltage battery or the low voltage battery.

13. The engine of claim 11, wherein a first end of the primary coil is selectively electrically connected to the high voltage battery or the low voltage battery, and a second end of the primary coil is grounded through a main switch.

14. The engine of claim 13, wherein the main switch comprises an emitter terminal, a collector terminal, and a base terminal, and wherein the second end of the primary coil is electrically connected to the collector terminal of the main switch, the emitter terminal is grounded, and the base terminal is electrically connected to the controller.

15. The engine of claim 14, wherein a first end of the secondary coil is electrically connected to the center electrode and a second end of the secondary coil is electrically connected to the emitter terminal of the main switch.

16. The engine of claim 15, further comprising a first further diode provided between the secondary coil and the emitter terminal, wherein the first further diode is configured to block a current from flowing from the secondary coil to the emitter terminal.

17. The engine of claim 16, further comprising a second further diode provided between the secondary coil and the center electrode, wherein the second further diode is configured to allow the current to flow only from the secondary coil to the center electrode.

18. An engine comprising:

a cylinder block;

a cylinder head combined with the cylinder block to define a combustion chamber therein;

a spark plug mounted in a mount hole of the cylinder head, wherein a lower portion of the spark plug protrudes into the combustion chamber;

a center electrode provided at the lower portion of the spark plug;

a ground electrode provided at the lower portion of the spark plug;

an ignition coil electrically connected to the center electrode and the ground electrode and comprising a primary coil and a secondary coil, wherein the ignition coil is configured to be selectively powered from a high voltage battery or a low voltage battery by control of a controller; and a battery switch provided between the high voltage battery and the ignition coil and a diode provided between the low voltage battery and the primary coil of the ignition coil, wherein electric power is supplied to the ignition coil from either the high voltage battery or the low voltage battery according to switching of the battery switch, wherein the diode is coupled to allow current to flow from the low voltage battery to the primary coil of the ignition coil and to prevent current from flowing from the high voltage battery to the low voltage battery.

19. The engine of claim 18, wherein the controller is configured to:

control spark discharge generated between the center electrode and the ground electrode by adjusting a charging current and a charging time; and perform switching control so that the electric power is selectively supplied to the ignition coil from the high voltage battery or the low voltage battery.

20. The engine of claim 18, wherein when the battery switch is turned on, the electric power is supplied from the high voltage battery to the primary coil of the ignition coil, and wherein when the battery switch is turned off, the electric power is supplied from the low voltage battery to the primary coil of the ignition coil.

* * * * *